United States Patent [19]

McIntyre

[11] Patent Number: 4,911,948

[45] Date of Patent: Mar. 27, 1990

[54] METHOD OF SCREEN PRINTING AND APPLICATION OF HOT MELT UPON MOVING WEB SUBSTRATES

[75] Inventor: Frederic S. McIntyre, Wellesley, Mass.

[73] Assignee: Acumeter Laboratories, Inc., Marlborough, Mass.

[21] Appl. No.: 241,182

[22] Filed: Sep. 7, 1988

[51] Int. Cl.[4] ..... B05D 3/02

[52] U.S. Cl. ..... 427/45.1; 427/208.2; 427/428; 427/282

[58] Field of Search ..... 427/208.2, 282.2, 45.1, 427/428

*Primary Examiner*—Bernard Pianalto

*Attorney, Agent, or Firm*—Rines and Rines Shapiro and Shapiro

[57] ABSTRACT

A novel hot-melt and other viscous fluid and coating screen-printing method and apparatus in which a line of fluid is extruded against a predetermined region of a rotary screen opposite which a web is drawn to transfer the fluid extruded at said region through the screen pores, with large cross-section fluid extrusion sealed against the inner wall of the screen as the same rotates past said region, and with features of fluid pressure and screen heating synchronous and proportional to line speed, inerted inner screen cavity construction (and possible exterior inerting of the screen, and novel web drawing roller positioning, including web-movement rotation of the screen, and all accommodating high viscosty fluids and high web speeds.

7 Claims, 2 Drawing Sheets

METHOD OF SCREEN PRINTING AND APPLICATION OF HOT MELT UPON MOVING WEB SUBSTRATES

The present invention relates to hot melt and other viscous fluid screen-printing and application methods or processes and apparatus, including adhesives and other coating materials, () also room temperature coatings and patterned deposits for moving web and other substrates.

There are currently employed hot melt screen printing processes and apparatus offered by several manufacturers [Kramer (NJ), LTI (CA), and Meltex (West Germany)], utilizing a slot nozzle of the type described in U.S. Pat. No. 3,595,204 of the assigned of the present invention, and located within the inside periphery of a screen like cylinder sleeve. As the screen rotates around the stationary nozzle, fluid is discharged from the slot nozzle through the screen material. A web passes in contact with the screen cylinder/sleeve, by way of a laminating or positioning roll, in which the center of the roll is located directly opposite to that position of the slot nozzle fluid or coating material extrusion. Modifications utilize only the slot nozzle as the fluid distribution means, without making physical contact with the inside surface of the screen. A spring metal wiper blade is generally attached to the lower portion of the slot nozzle, for collecting a reservoir of fluid and to exert mechanical force upon the fluid for fluid passage through the screen member. Such apparatus and techniques, however, are subject to serious limitations among which are both speed and viscosity limitations, due to the inability to provide adequate mechanical fluid force to push the fluid through the screen pattern at higher speed rates of 50 meters or more per minute, and high fluid viscosities greater than 15,000–20,000 cps. Current equipment designs of this character usually create a localized fluid force, either at the slot nozzle opening (i.e. of the order of 1/16" in the direction of screen travel), or a tangential contact area made by the mechanical wiper blade. Such limitations or deficiencies restrict this process from applying materials that are of higher viscosities and/or operating at higher production speeds. In addition to the above restrictions or deficiencies, the heating methods used for heating of the screen cylinder sleeve material are generally either hot air or infra-red, which both have limitations as well. The hot air system causes quick oxidation of the hot melt materials, thus destroying the physical properties of most hot melts. The infra red systems used are relatively responsive to the heating of the screen material. However, when using either the hot air or infra red systems, the screen material does not receive sufficient heat at higher machine speeds, due to a greater heat loss transfer to the substrate versus the heat input to the screen.

The object of the present invention, accordingly, is to provide a new and improved screen-printing or applicating method and apparatus that obviate the above-described speed and viscosity limitations and other disadvantages of prior art systems, including also heat degradation of coating materials. Other and further objectives will be explained hereinafter and are more particularly delineated in the appended claims.

In view of the removal of restrictions upon high hot melt or other fluid viscosities and high speed of screen printing by the invention, a greater flexibility of the use of hot melt and related screen printing coatings is now possible, including special shapes of fluid deposits made in register with other synchronous processes, for making complete products. As an example, pressure sensitive labels of today utilize full coatings of adhesive outside of the perimeter of the finished die-cut label, since the coating means is continuous, at high speed, and without pre-pattern coating. The use of screen printing of the present invention, will localize the adhesive deposit to the shape of the label, without adhesive deposit outside of the label, which will, therefore, result in higher production speeds for removal of the lattice or scrim material after die cutting. Additional uses include special adhesive or coatings onto non-woven tissue, plastic films, etc., for specialized medical products, and the like, whereby adhesive deposits are localized where needed, and not applied where not required. Medical products require special shapes of coatings, such as bandages, surgical dressings, etc. In the soft disposable industry, special shaped incontinent and adult diaper products require perimeter fluid deposits, in order to seal all of the respective edges and which cannot be obtained by means other than full, continuous coating, which represents a waste of coating material.

Underlying the present invention are the following principal features, all or some of which in combination enable the novel performance achievable by the invention and the overcoming of the problems and limitations experienced by current screen printing apparatus before described. These features include:

(A) Providing additional surface area within the fluid dispensing nozzle distribution cavity for exposing the fluid to the screen cylinder sleeve.

(B) Providing for both proportional and synchronous pressurized fluid supply to the screen for forcing fluid through the screen, rather than utilizing a positive displacement volumetric pump or means as is currently generally employed.

(C) Providing improved heating means for elevating the temperature of the screen to provide for controlled temperature of the screen cylinder sleeve and for preventing solidification of hot melt like materials without degradation of the hot melt, and/or to provide improved fluid transfer from the screen cylinder sleeve to a substrate which may be at room temperature or slightly elevated in temperature.

(D) Providing an improved support roller system for the positioning of the web substrate against the screen cylinder sleeve to obtain improved fluid transfer from the screen to the substrate, and for enabling the moving web to rotate the screen, if desired.

(E) Providing a means for inerting either or both interior of screen cylinder and exterior, for minimizing the oxidation of the coating materials, irrespective of coating materials used (i.e. hot melt, solvent or emulsion, 100% solid coating, and thermal curing or UV/EB curing).

(F) Expanding the types of coating materials now adapted for screen printing and including low and high viscosity hot melt, solvent or emulsion, 100% solids for thermal curing or UV/EB curing.

In summary, from one of its important viewpoints, the invention embodies a method of screen-printing hot melt and other viscous fluid and coating materials, upon moving webs and other substrates, that comprises, extruding such fluid materials under pressure upon a predetermined region of the inner surface of a rotating application screen to force extruded fluid material through the pores of the screen as it rotates past said region, drawing the web against the exterior of the screen at or just below said region to transfer the fluid forced through the screen pores at or near said region to the web, adjusting the cross dimension of the extruded material to be sufficiently large for the viscosity of the material and the size of the screen pores to permit the pressurized extruded fluid material to achieve sufficient surface area both to seal against said region of the inner surface of the screen and to respond for passage through the screen pores, and adjusting the pressure upon the extruded fluid material to be synchronous and proportional to web speed to enable the same incremental square area pressure of fluid extruded against said region of the inner surface of the screen irrespective of speed.

Preferred and best mode embodiments and constructional details are hereinafter presented.

BRIEF DESCRIPTION OF THE DRAWINGS

The invention will not be described with referene to the accompanying drawings.

DETAILED DESCRIPTION OF THE DRAWINGS

Figure 1:
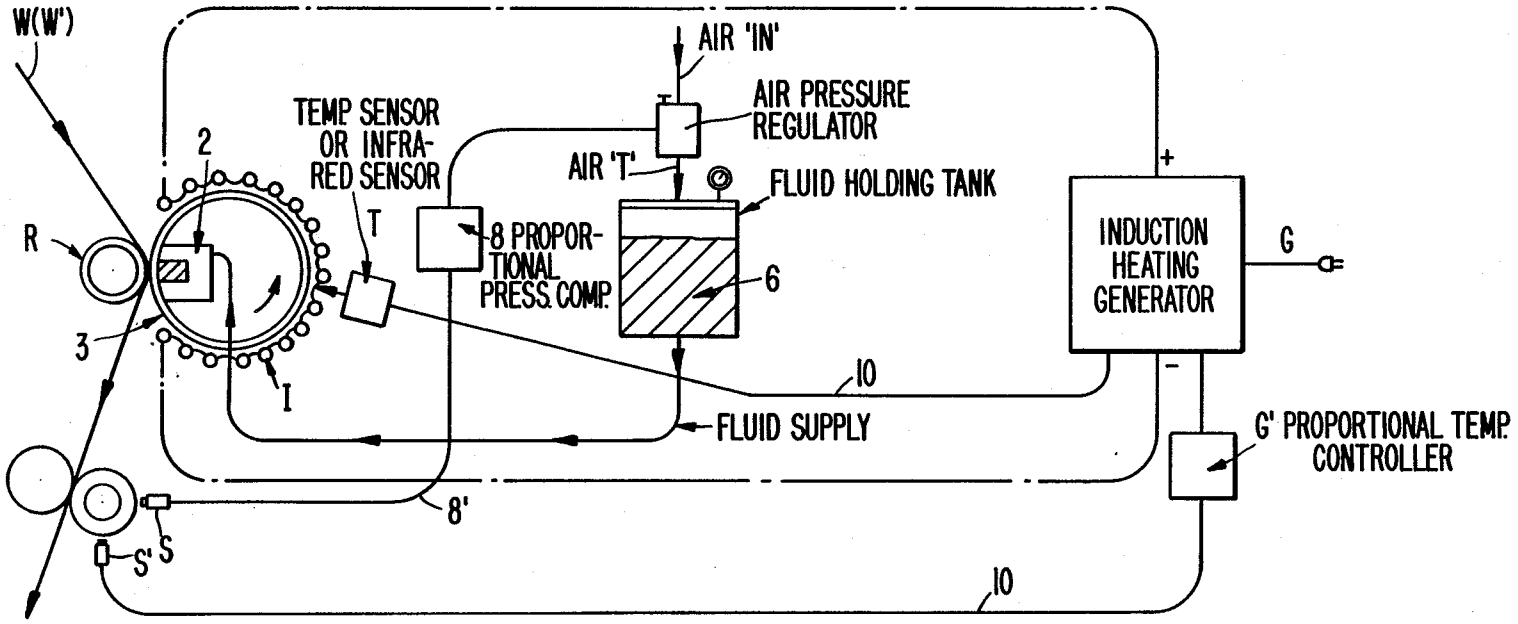
FIG. 1 of which is a schematic drawing of a preferred screen printing or applicating apparatus for practicing the method or process or technique of the invention.

In preferred form, the slot-die nozzle of said U.S. Patent is employed at 2 in FIG. 1 for the fluid distribution within the nozzle to obtain uniform fluid displacement exiting from the nozzle (at the left). The nozzle fluid exit longitudinal slot transverse opening or zone (0 in FIG. 4), is increased far beyond normal slot transverse openings as insaid U.S. Patent, to provide for a minimum of about ½" (13 MM) opening or cross dimension for the extruded fluid to contact the inside surface of the rotating screen 3, along the longitudinal line of the slot. As more particularly shown in FIG. 3, the exiting lip surface of the adjacent walls of the slot nozzle will make contact with a predetermined region (the 270 deg. region) of the inner surface of the screen 3 along the slot for providing a fluid seal thereat. The space at each end of the nozzle (not shown) will have a filler piece that will have the same dimensions as the opening of the nozzle (½"), and curved, as at C in FIG. 4, to match the circular dimensions of the screen cylinder. The objective of providing a substantially large nozzle tranverse opening 0 or extrusion cross dimension is to permit the pressurized fluid within the reservoir to obtain additional surface area and resultant time for the fluid to respond for passage through the pores or openings in the screen cylinder sleeve material. Depending upon the screen openings size(s) and the viscosity of the fluid, the nozzle opening 0 may be further opened in order to provide additional time for fluid passage through the pores or openings of the screen material. As an example, small holes in a screen will provide greater resistance for fluid passage than those of large holes. Likewise, high viscosity materials or fluids which possess non-Newtonian flow characteristics will require a nozzle of larger slot opening 0, FIG. 4, in order to obtain additional time for fluid passage through the screen openings. Heating may be required for changing the relative viscosity and flow properties for non-hot melt like materials, whereas heating is a prerequisite for hot melt type materials as before mentioned and as later more fully discussed.

As in common practice, the screen material, such as 0.020" thick, will be provided with a photo imaging polymer coating which is photo polymerized to provide, openings in the screen 3 for providing for fluid passage in patterns according to the photo image. These patterns are not necessarily regular in width or continuous, since the desired fluid deposit patterns may have irregular shapes, such as squares, diamonds, circular, donuts, script, etc. The fluid displacement system must be capable of compensating for the ever changing screen opening area as the screen rotates past the fluid distribution nozzle 2, either by its own drive or in response to the engaging movement of the web W contacting the exterior of the screen opposite the nozzle by the "Process Metering Drive", FIG. 1. Positive displacement metering pump systems, generally used with such hot melt and related coating nozzles, are volumetric devices, however, rather than pressure displacement devices. The positive displacement device will thus not universally work satisfactorily due to the fact that the gear pump speed cannot be quickly regulated in a cyclic manner to adjust for the changing screen area openings and closings during screen rotatin past the slot nozzle.

In accordance with the present invention, this problem is admirably overcome by providing, in contrast, a pressure means for fluid displacement from a reservoir 6, FIG. 1, to the coating nozzle 2, enabling uniform fluid pressure per square area of exposed screen to the open slot. The fluid displacement, therefore, and the passage through the screen 3 will be uniform, yet always compensating for the varying screen area openings. The pressure imposed upon the fluid should be synchronous and proportional to process web speed, as effected by air pressure regulator 10 and proportional pressure control 8, so as to maintain the same incremental square area pressure of fluid extruded against the inside of the screen 3 for insuring consistent fluid passage at all machine process speeds. The pressure regulating system 8 is controlled by a speed regulation feedback closed loop circuit 8' to provide for proportional and synchronous pressure supply to the fluid delivery system.

The feedback path 8' is controlled by the web speed sensing at 5, FIG. 1. The fluid system may be heated for improving non-Newtonian flow properties of non-hot melt like materials for minimizing pressure losses from the reservoir to the slot nozzle apparatus, whereas hot melt materials require heating. In accordance with the present invention, in order to obviate the limitations of prior screen air or infra red heating systems previously discussed, an induction heating system is employed at I, FIG. 1 and FIG. 3, disposed coaxially around the periphery of the screen cylinder sleeve 3 on either side of the nozzle region, for maintaining a predetermined temperature throughout the speed range of the screen printing process. A temperature controlled sensor, T, FIG. 1, either in physical contact with the screen material, or an infra red temperature proximity sensing system T, will be used for obtaining temperature feedback at 10 and temperature maintenance of the screen material from the induction heating generator G. A proportional speed temperature control device S' and G' will be used to signal the inducting heating generator G to maintain a pre-set temperature.

Fluid transfer from screen 3 to the web substrate W may cause stringing or cob webbing of the fluid during the transfer process. The stringing and cob webbing condition with hot melt is normally the result of a rapid cooling of the fluid during fluid transfer from the screen to the web substrate W down against and past the screen 3. To minimize this condition, close temperature regulation of the screen material is required so that the temperature loss within the screen 3 and the fluid will be minimal. In some instances, heating the web substrate W to a predetermined temperature prior to, but up to the point of fluid application, as at W' in FIG. 1, will minimize the temperature gradient of the fluid and therefore minimize the stringing and cob-webbing effect. Fluid coating materials which are not hot melt types can utilize heat as a means of assisting in reducing the elastomeric property during fluid transfer, with the result that the fluid transfer is complete without such stringing and cob webbing.

Figure 2A:
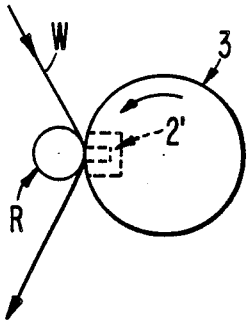
FIGS. 2A, 2B and 2C are diagrams of single, modified single and dual roller web positioning systems for use in the apparatus of FIG. 1.
Figure 2B:
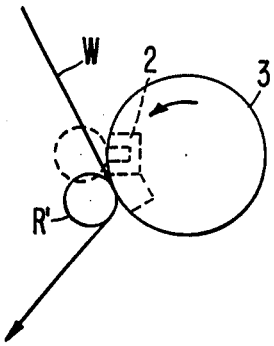
Figure 2C:
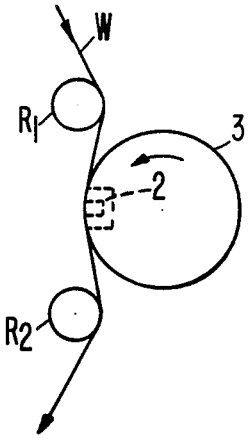

To accomplish the purposes of the invention, an appropriate web positioning roller system R, FIG. 1, either driven or non-driven, is required to position the web substrate W against the rotating screen cylinder sleeve 3, for obtaining fluid transfer to the web substrate, and to drive or rotate the screen 3, if a separate screen drum drive is not desired. Suitable systems, particularly adapted for high speed operation, are shown in FIGS. 2A, 2B and 2C. In the event that a single roller R is used, FIGS. 1, 2A and 3, it will be located directly opposite the extrusion region of the slot nozzle coating head 2, or directly beyond (below) the slot cavity exit zone at R', FIG. 2B, in order to optimize fluid transfer to the web substrate W being drawn past the region of the nozzle opening. In the latter case, the nozzle member 2 may require an extension (not shown) for supporting the screen 3 when the roller R' is contacting beyond the fluid distribution cavity 2 to prevent deflection of the screen 3 away from the web substrate W. Such positioning permits the fluid to pass through the screen 3 prior to web co tact with the fluid.

An alternate means of web placement against the screen 3 includes two rollers R1 and R2, FIG. 2C, one of which (R1) is located before (above) the fluid distribution nozzle cavity 2 for introducing the web contact to the screen cylinder 3 before the fluid transfer zone section. The second roller R2 contacts the web and holds it inward below the extrusion region 2. The use of two rollers out of contact with the screen provides for additional contact time for the web substrate to receive fluid at the extrusion region transfer. At higher process speeds, the time dwell for web contact is an inverse function of time, as compared to slow process speeds. To obtain complete transfer of fluid, a time constant is required to achieve this end. The two roller system R1 and R2 may satisfy and complete the fluid transfer for some fluid types, whereas other types of coating materials only require a single roller.

Figure 3:
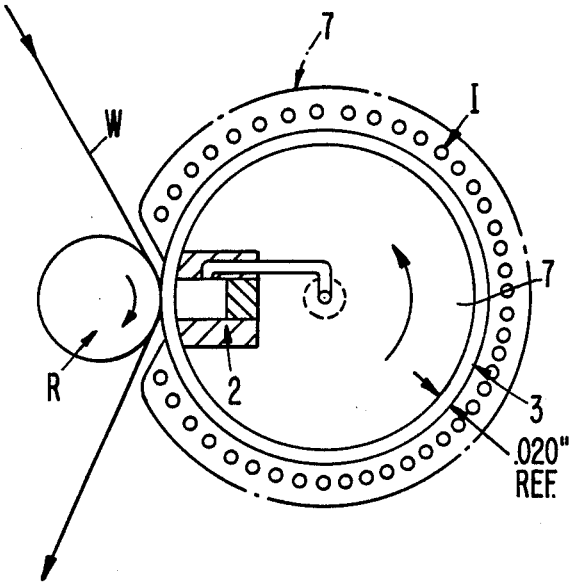
FIG. 3 and 4 are sectional views, upon an enlarged scale, of the screen printing assembly and the slot-die nozzle portion of the apparatus of FIG. 1.
Figure 4:
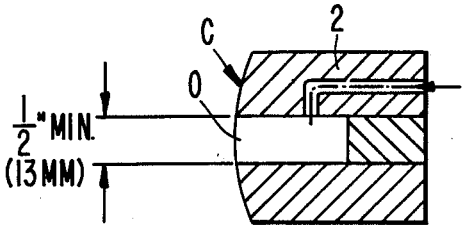

Many coatings, before cooling, drying or cross linking/curing, are oxygen inhibited when exposed to oxygen, resulting in deterioration of the final physical properties. Typically, hot melt pressure sensitive adhesives which are either ethyl vinyl acetate (EVA) based, or a rubber co-block polymer base, are easily degradable when simultaneously exposed to air in the heated state. Normal atmosphere conditions cause the oxygen further to oxidize the coating materials to a point where the final physical properties are not the same as originally supplied to the coating system. Some other coatings, like solvents or emulsion types, are likewise sensitive to the presence of oxygen or require a controlled atmosphere to minimize evaporation of the solvent vehicle, whether it be a volatile so vent like methyl ethyl ketone, or water. In such instances, an inerted atmosphere 7, as of nitrogen contained within the screen cylinder 3, FIG. 3, provides minimal change in the physical properties of the coating material. If desired an external shield shell containing such an inerting atmosphere may also be provided as at 7', FIG. 3. Some urethane based materials are hydroscopic when exposed to the atmosphere and such moisture cure adhesive type coatings/adhesives, develop changes in physical state when contacted by moisture. The inerting process provides a dry atmosphere and therefore has the ability to minimize or slow the rate of cross linking.

Lastly, there are moisture cure silicone coatings, such as those of Dow Chemical (USA), that are designed to convert a liquid to a solid state through the reaction of moisture absorption. The inerting system will minimize the rate at which the hydroscopic process occurs and therefore makes possible use of the screen printing process for those types of materials, also.

Indeed, a wide gamut of low and high viscosity fluid materials may now be used for screen printing. Preferred coating materials include hot melt, solvents and emulsions, 100% solid room temperature coatings and the like, including low to medium high viscosity rubber base hot melts, such as those manufactured by Findley (USA), Malcolm Nicol (USA), and Fuller (USA), such as the Fuller product HM1597. Viscosity of such materials range from 10,000 to 20,000 cPs at 175 deg. C., ethyl vinyl acetate (EVA) product of similar viscosities 10,000 to 20,000 cPs at 175 deg. C., such as the Malcolm Nicol product 2-289, solvent rubber based adhesive, having viscosity of 1,500 cPs at 23 deg. C., such as Fuller's SC1341EN; emulsion acrylic type adhesive of Rohm & Haas, having a viscosity of 1,000 cPs, such as product PS-83, room temperature 100% solid UV/EB curable adhesive coating, such as manufactured by Dynamit Nobel (West Germany), product 1330, having a high viscosity of around 100,000 cps; and thyxotropic or dilatant products, such as Malcolm Nicol's product 2-2419, having a high viscosity of 25,000 cPs, at 175 deg. C.

Further modifications will occur to those skilled in this art, including and separate screen rotational drive than the web itself, or the roll R as a drive, and such are considered to fall within the spirit and scope of the invention as defined in the appended claims.

What is claimed is:

1. A method of screen-printing hot melt and other viscous fluid and coating materials, upon moving webs and other substrates, that comprises, extruding such fluid materials under pressure upon a predetermined region of the inner surface of a rotating application screen to force extruded fluid material through the pores of the screen as it rotates past said region, drawing the web against the exterior of the screen at or just below said region to transfer the fluid forced through the screen pores at or near said region to the web, adjusting the cross dimension of the extruded material to be sufficiently large for the viscosity of the material and the size of the screen pores to permit the pressurized extruded fluid material to achieve sufficient surface area both to seal against said region of the inner surface of the screen and to respond for passage through the screen pores, and adjusting the pressure upon the extruded fluid material to be synchronous and proportional to web speed to enable the same incremental square area pressure of fluid extruded against said region of the inner surface of the screen irrespective of speed.

2. A method as claimed in claim 1 and in which said pressure adjusting is effected by fluid displacement pressure compensating for changing screen opening area as the screen rotates past the extrusion region.

3. A method as claimed in claim 1 and in which the screen is heated about its periphery and the temperature is controlled synchronously and proportionally with web speed.

4. A method as claimed in claim 3 and in which the heating is inductively applied coaxially about the screen.

5. A method as claimed in claim 3 and in which at least one of the inner cavity of the screen and the outer surface of the screen is inerted to prevent degradation of the heated extruded fluid material.

6. A method as claimed in claim 1 and in which the web is drawn against the outside surface of the screen at or near said region, being held there-against by roller pressure applied to the web at one of the following regions: opposite and against the screen at the said extrusion region; just beyond said extrusion region and against the screen; and inwardly above and below said extrusion region forcing the web against the screen at said region.

7. The method as claimed in claim 1, and in which rotating of the screen is effected by the moving contact of the web on the exterior of the screen.

* * * * *